US006203381B1

(12) United States Patent
Lai et al.

(10) Patent No.: US 6,203,381 B1
(45) Date of Patent: Mar. 20, 2001

(54) ELECTRICAL CONNECTOR

(75) Inventors: Chin-Yi Lai; Kun-Tsan Wu, both of Tu-Chen; Chaur-Shiuh Chen, Chia-I, all of (TW)

(73) Assignee: Hon Hai Precision Ind. Co., Ltd., Taiepi Hsien (TW)

( * ) Notice: Subject to any disclaimer, the term of this patent is extended or adjusted under 35 U.S.C. 154(b) by 0 days.

(21) Appl. No.: 09/196,431

(22) Filed: Nov. 19, 1998

(30) Foreign Application Priority Data

Nov. 19, 1997 (CN) ..... 86219459

(51) Int. Cl.[7] ..... H01R 13/514
(52) U.S. Cl. ..... 439/701
(58) Field of Search ..... 439/701, 692, 439/693, 660, 78–79

(56) References Cited

U.S. PATENT DOCUMENTS 5,725,397 * 3/1998 Fukamachi et al. ..... 439/701
5,975,917 * 11/1999 Wang et al. ..... 439/79

* cited by examiner

*Primary Examiner*—Khiem Nguyen
*Assistant Examiner*—Eugene G. Byrd
(74) *Attorney, Agent, or Firm*—Wei Te Chung

(57) ABSTRACT

An electrical connector includes an insulator defining an interior space for receiving therein a pin module formed by embedding conductive pins on an insert. Retention members are provided in the interior space between the insulator and the pin module including a first bound to limit the movement of the pin module in a first direction and a second bound to limit the movement of the pin module in an opposite second direction thereby effectively retaining the pin module in the insulator. The modularization of the pins received in the insulator allows the pins to be assembled into the insulator much more efficiently while the retention members effectively prevent the pin module from separating from the insulator.

21 Claims, 17 Drawing Sheets

ELECTRICAL CONNECTOR

FIELD OF THE INVENTION

The present invention generally relates to an electrical connector, and in particular to a ready-to-assemble firm structure of the electrical connector.

BACKGROUND OF THE INVENTION

Electrical connectors are widely used to establish electrical and signal connection between two devices, such as two telecommunication devices. With the development of high frequency transmission technology, the number of the contact points in an electrical connector has been significantly increased which enhances the data transmission capability of the connector; however, the manufacture thereof becomes more complicated. An increase in the number of pins within a limited space is a difficult obstacle for the connector manufacturers to overcome because the pitch of the pins is reduced thereby increasing the likelihood that the pins will accidentally contact each other.

Conventional multiple contact point connectors are disclosed in U.S. Pat. No. 5,219,294 and Taiwan Patent Application No. 85100751. The Taiwan patent teaches to stack the pins in rows and form a modularized component which is then secured to an insulator by means of retention means. Such a structure increases the assembly efficiency of the connector, but the retention means may not be effective in securing the modularized pin component to the insulator whereby the pins may be moved out of and even detached from the insulator during connection/disconnection of the connector to/from a mating connector. A conventional connector structure is shown in FIGS. 1 and 2. The conventional connector comprises a stack of pin modules 50 fixed together by means of a tapered section 52 extending in the direction of the stack. The pin module 50 forms a conic configuration 54 on a lateral side thereof for forming an interferential fit between the pin module 50 and an insulator. However, the conic configuration 54 extends in the same direction as a force applied thereto for connecting the connector to a mating connector whereby an increase in the number of contact engagements between the connector and the mating connector causes the pin module 50 to gradually disengage from the insulator.

Furthermore, in multiple contact point connectors, each pin has a mounting section for being mounted to a circuit board. To prevent unexpected contact from occurring between the mounting sections of two adjacent pins, a spacer is usually provided, for receiving the mounting sections of the pins in holes defined therein. Such a spacer is disclosed in Taiwan Patent Application Nos. 81210871 and 84207642 and U.S. Pat. No. 5,125,853. With the increase in the number of the pins, it becomes difficult to simultaneously insert the mounting sections of the pins into the holes of the spacer. To overcome such a problem, an additional jig is used. This increases costs and is not effective in enhancing assembly efficiency.

It is thus desirable to provide an improved electrical connector structure which simplifies the assembly thereof while providing a firm construction so as to overcome the disadvantages encountered in the prior art.

SUMMARY OF THE INVENTION

Accordingly, it is an object of the present invention to provide an electrical connector structure having pin modules securely fixed therein whereby the likelihood of detachment of the pin module from an insulator of the connector is remarkably reduced thereby providing stable data and signal transmission.

It is another object of the present invention to provide an electrical connector having a structure which facilitates assembly and has a firm construction thereby ensuring the quality of the connector.

To achieve the above objects, an electrical connector in accordance with the present invention comprises an insulator defining an interior space for receiving a pin module therein. The pin module is formed by embedding conductive pins in an insert for reception in the interior space of the insulator. Retention members are provided in the interior space between the insulator and the pin module. Each retention member includes a first bound for limiting movement of the pin module in a first direction and a second bound for limiting movement of the pin module in an opposite second direction thereby effectively retaining the pin module in the insulator. The modularization of the pins facilitates efficient assembly thereof into the insulator while the retention members effectively prevent the pin module from separating therefrom.

In accordance with another aspect of the present invention, a connection system comprises a plug-type connector and a socket-type connector matingly engaged with each other wherein both have the structure described above.

BRIEF DESCRIPTION OF THE DRAWINGS

The present invention will become apparent to those skilled in the art by reading the following description of a preferred embodiment thereof with reference to the accompanying drawings in which.

DETAILED DESCRIPTION OF THE PREFERRED EMBODIMENTS

Figure 18:
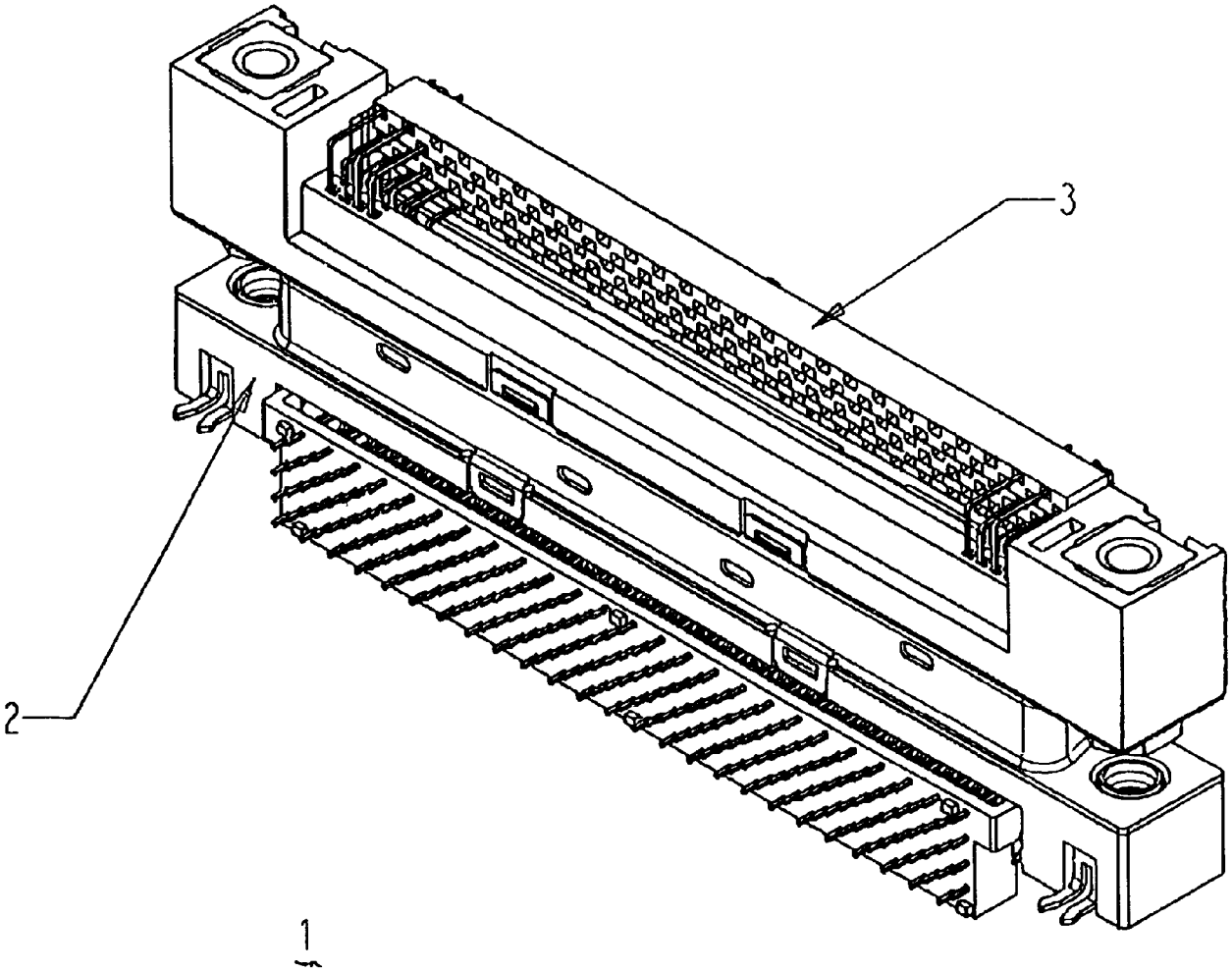
FIG. 18 is a perspective view of a connection system in accordance with the present invention wherein the plug-type connector is matingly engaged with the socket-type connector.

With reference to the drawings and initially to FIG. 18, wherein a connection system 1 comprising a plug-type connector 2 and a socket-type connector 3 engaged therewith, both constructed in accordance with the present invention, are shown.

Figure 2:
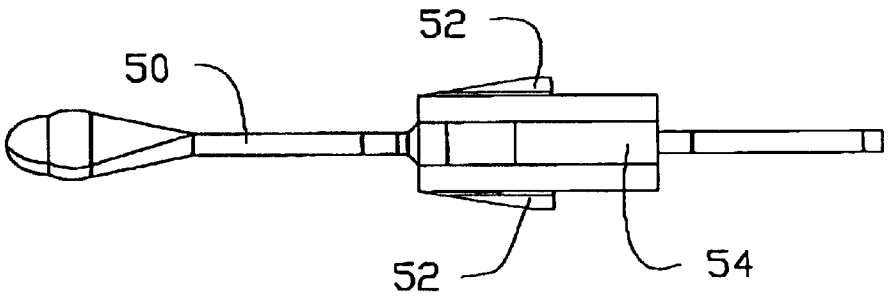
FIG.2 (PRIOR ART)
FIG. 2 is a plan view showing a pin module of the connector shown in FIG. 1.
Figure 1:
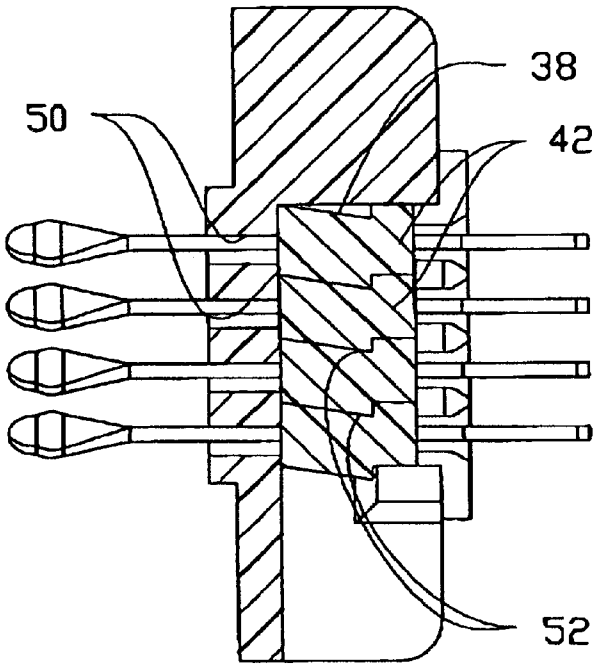
FIG.1 (PRIOR ART)
FIG. 1 is a cross-sectional view showing a conventional connector.
Figure 3:
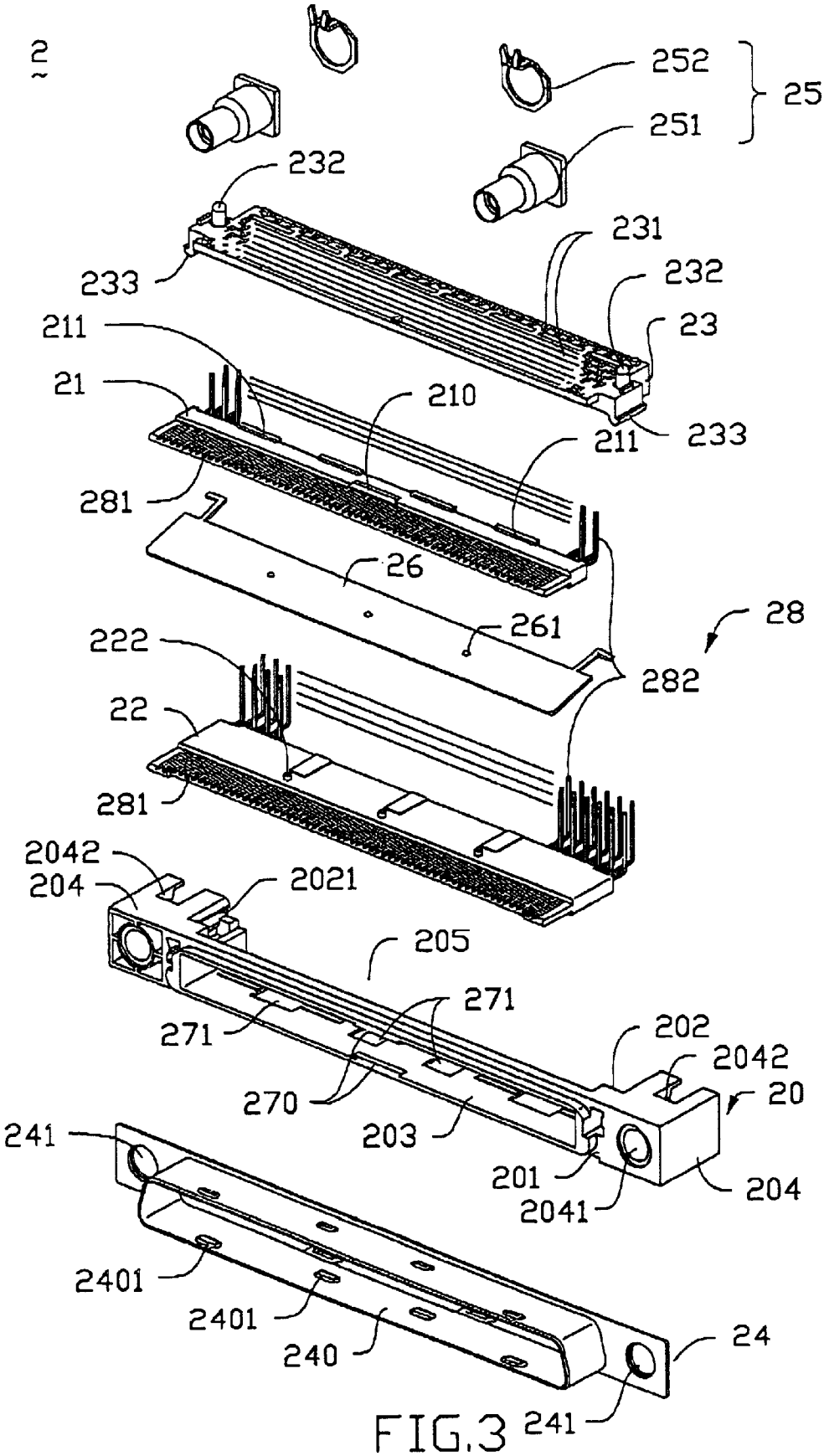
FIG. 3 is an exploded perspective view showing a plug-type connector constructed in accordance with the present invention.

With particular reference to FIG. 3, the plug-type connector 2 comprises an insulator 20 forming an elongate body made of dielectric material, having a first side face 201 for engaging with the socket-type connector 3 and a second side face 202 opposite the first side face 201. A slot 203 is defined in the insulator 20 between the first side face 201 and the second side face 202 for receiving therein a first insert plate 21 and a second insert plate 22 which serve as "plugs" to be inserted into the mating socket-type connector 3.

The insulator 20 integrally forms a mounting block 204 on each distal end thereof. A space 205 is defined between the two mounting blocks 204 and the second side face 202 of the insulator 20 for accommodating a spacer 23 therein. Each of the mounting blocks 204 defines a bore 2041 between the first and second side faces 201, 202 and a notch 2042 in the second side face 202 for respectively receiving therein a fastener 251 and an anchoring ring 252 having two elastically deformable legs (not labeled). The fastener 251 and the anchoring ring 252 together constitute securing means 25 of the insulator 20.

Figure 4:
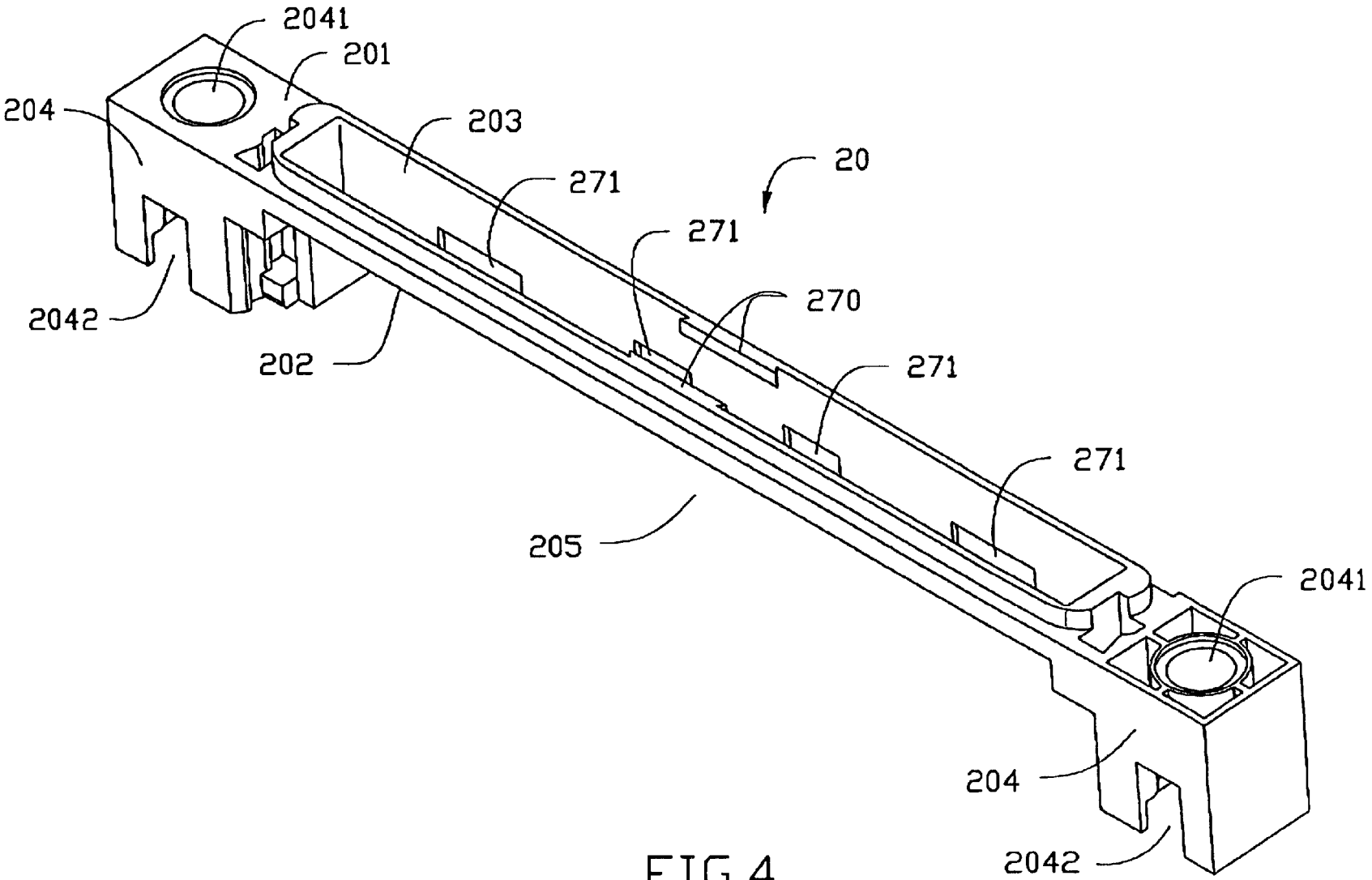
FIG. 4 is a perspective view showing an insulator of the plug-type connector of FIG. 3.

Further referring to FIG. 4, the insulator 20 comprises first retention means for retaining the insert plates 21, 22 in the slot 203 of the insulator 20. The first retention means comprises at least one dovetailed projection 270 formed on opposite inner surfaces of the slot 203 proximate the first side face 201 of the insulator 20. Each dovetailed projection 270 engages with a complementary notch 210, 220 (FIGS. 3 and 6) defined in the corresponding insert plate 21, 22 for preventing the insert plates 21, 22 from being driven toward the second side face 202 by the socket-type connector 3 during engagement with the plug-type connector 2. Each of the inner surfaces of the slot 203 defines a plurality of positioning recesses 271 proximate the second side face 202. The positioning recesses 271 on each inner surface of the slot 203 respectively receive complementary projections 211, 221 (FIGS. 3 and 6) formed on the first and second insert plates 21, 22 thereby preventing the insert plates 21, 22 from moving out of the insulator 20 from the first side face 201 thereof. The projections 211, 221 and the corresponding recesses 271 both have a rectangular configuration. The positioning recesses 271 cooperate with the dovetailed projections 270 to retain the insert plates 21, 22 in position within the slot 203. In the embodiment illustrated, each inner surface of the slot 203 forms one dovetailed projection 270 and four positioning recesses 271.

The insert plates 21, 22 each include a plurality of conductive pins 28 assembled therewith in a spaced manner, preferably equally spaced. The insert plates 21, 22 define grooves (not labeled) on both sides thereof for receiving and retaining the pins 28 therein.

Each of the pins 28 has an engaging section 281 and a mounting section 282. The engaging section 281 is received in the corresponding groove of the insert plates 21, 22 and located in the slot 203 while the mounting section 282 extends beyond the second side face 202 of the insulator 20 for being surface mounted to a printed circuit board (not shown).

Figure 5:
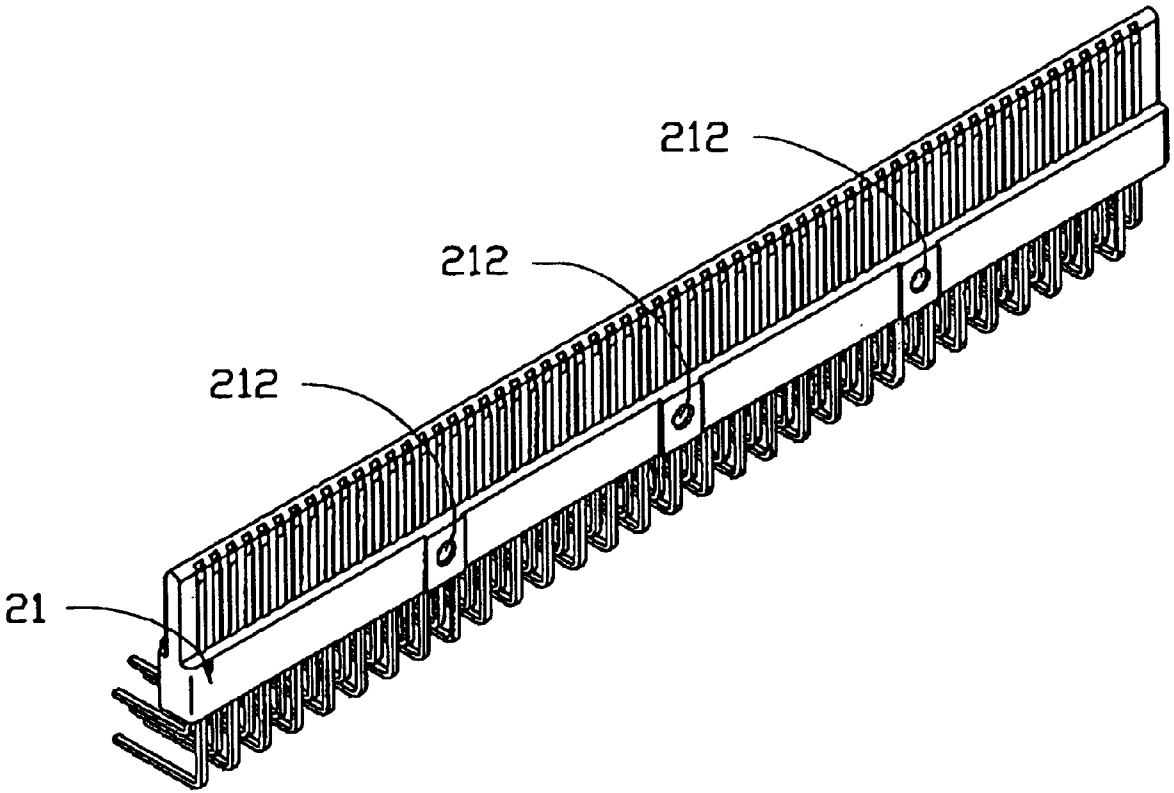
FIG. 5 is a perspective view of a first insert plate of the plug-type connector of FIG. 3.

Simultaneously referring to FIGS. 3 and 5, the first insert plate 21 defines a plurality of positioning holes 212 in a surface opposite the surface which forms the projections 211. Bosses 222 formed on the second insert plate 22 are received in the positioning holes 212 thereby maintaining a positional relationship between the insert plates 21, 22.

Figure 6:
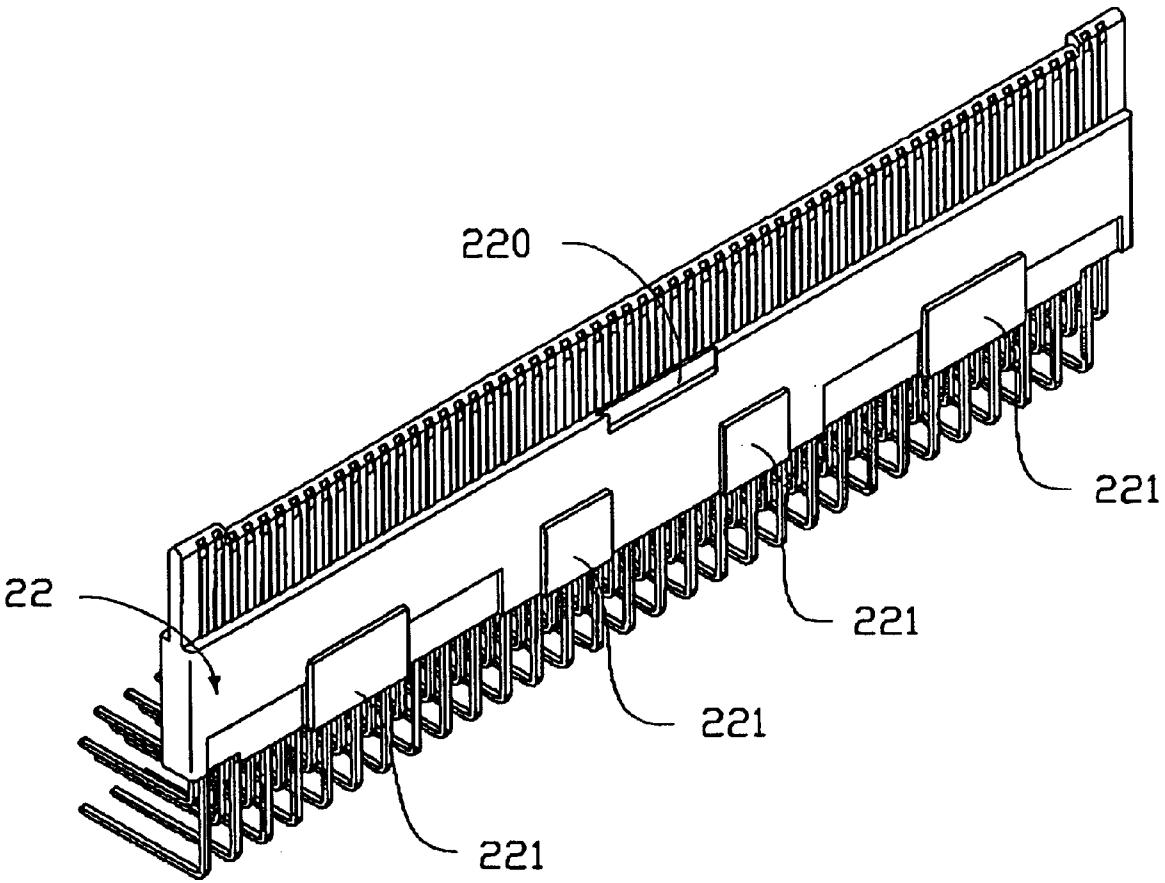
FIG. 6 is a perspective view of a second insert plate of the plug-type connector of FIG. 3.

Also referring to FIG. 6, the notch 220 and the positioning projections 221 are formed on a surface of the second insert plate 22 facing away from the first insert plate 21 and the bosses 222 (FIG. 3) are arranged on an opposite surface thereof. Thus, the notches 210, 220 and the positioning projections 211, 221 of the insert plates 21, 22 face the inner surfaces of the slot 203 of the insulator 20 to respectively engage with the dovetailed projections 270 and the positioning recesses 271 formed on the inner surfaces of the slot 203.

A grounding plate 26 defining through holes 261 therein is interposed between the insert plates 21, 22 wherein the bosses 222 of the second insert plate 22 extend through the through holes 261 of the grounding plate 26 for reception in the positioning holes 212 of the first insert plate 21.

The spacer 23 comprises a body (not labeled) received in the space 205 of the insulator 20 and defining a plurality of holes 231 therein for retaining the mounting sections 282 of the pins 28. The spacer 23 forms two positioning pins 232 near distal ends thereof for positioning the connector 2 on a printed circuit board. The spacer 23 also forms barbs 233 for engaging with corresponding shoulders 2021 formed on the mounting blocks 204 proximate the second side face 202 of the insulator 20 thereby fixing the spacer 23 thereto.

A shielding shell 24 is fixed to the first side face 201 of the insulator 20. The shell 24 forms a D-shaped bracket 240 for engaging with a raised section (not labeled) formed on the first side face 201 of the insulator 20 around the slot 203. A plurality of projections 2401 are formed on the bracket 240 for interferentially engaging with the raised section of the insulator 20 thereby fixing the shell 24 thereto. The shell 24 forms two end extensions (not labeled) each defining a bore 241 therein for receiving the fastener 251 which is also received in the bore 2041 of each of the mounting blocks 204 of the insulator 20 thereby securing the shielding shell 24 to the insulator 20.

Figure 7:
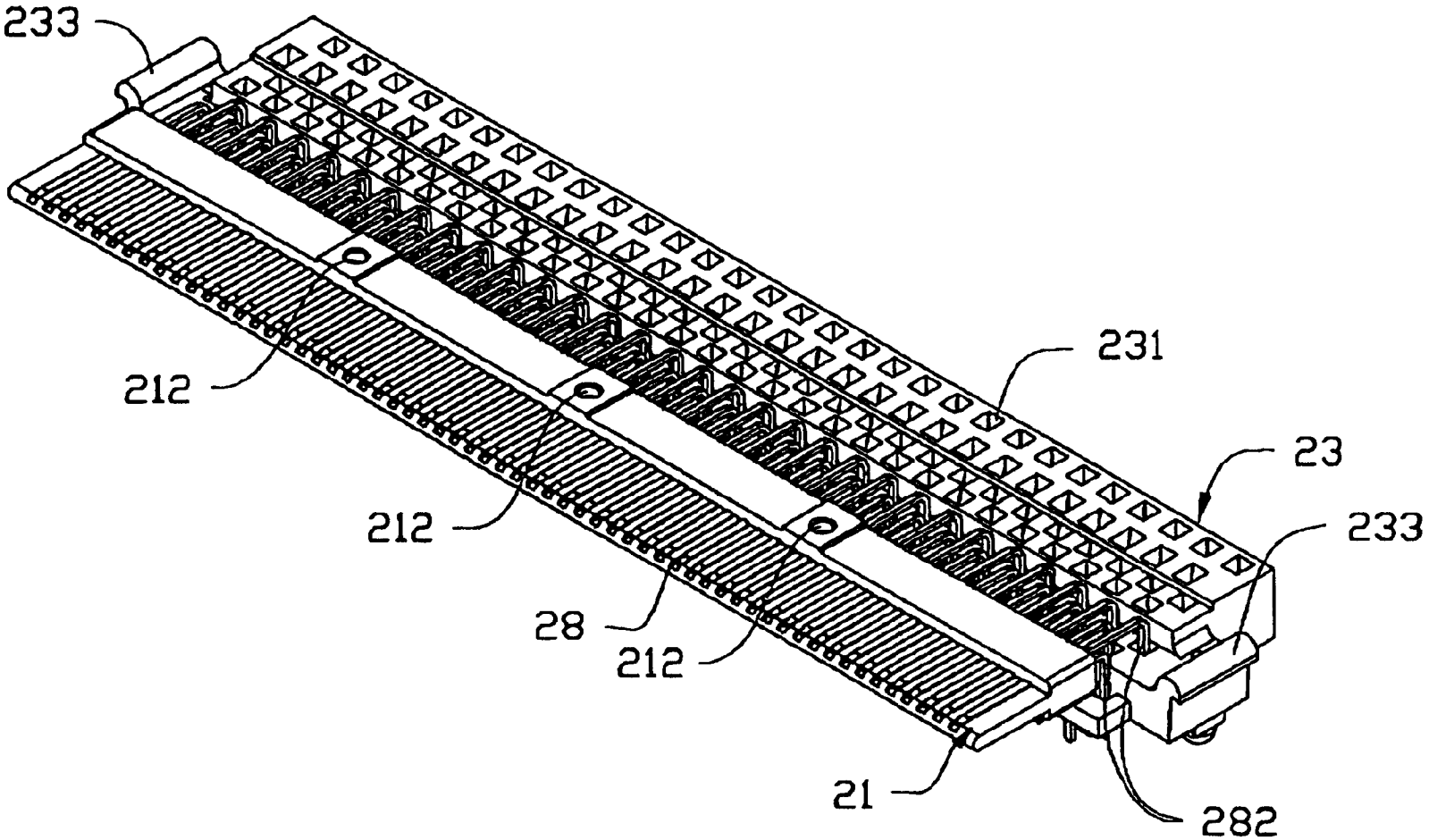
FIG. 7 is a perspective view of the first insert plate mounted to a spacer.

FIGS. 7–10 show different steps of assembling the plug-type connector 2. The first insert plate 21 forms a unitary member together with the pins 28 mounted therein whereby the mounting sections 282 of the pins 28 are inserted into the corresponding holes 231 of the spacer 23 (FIG. 7).

Figure 8:
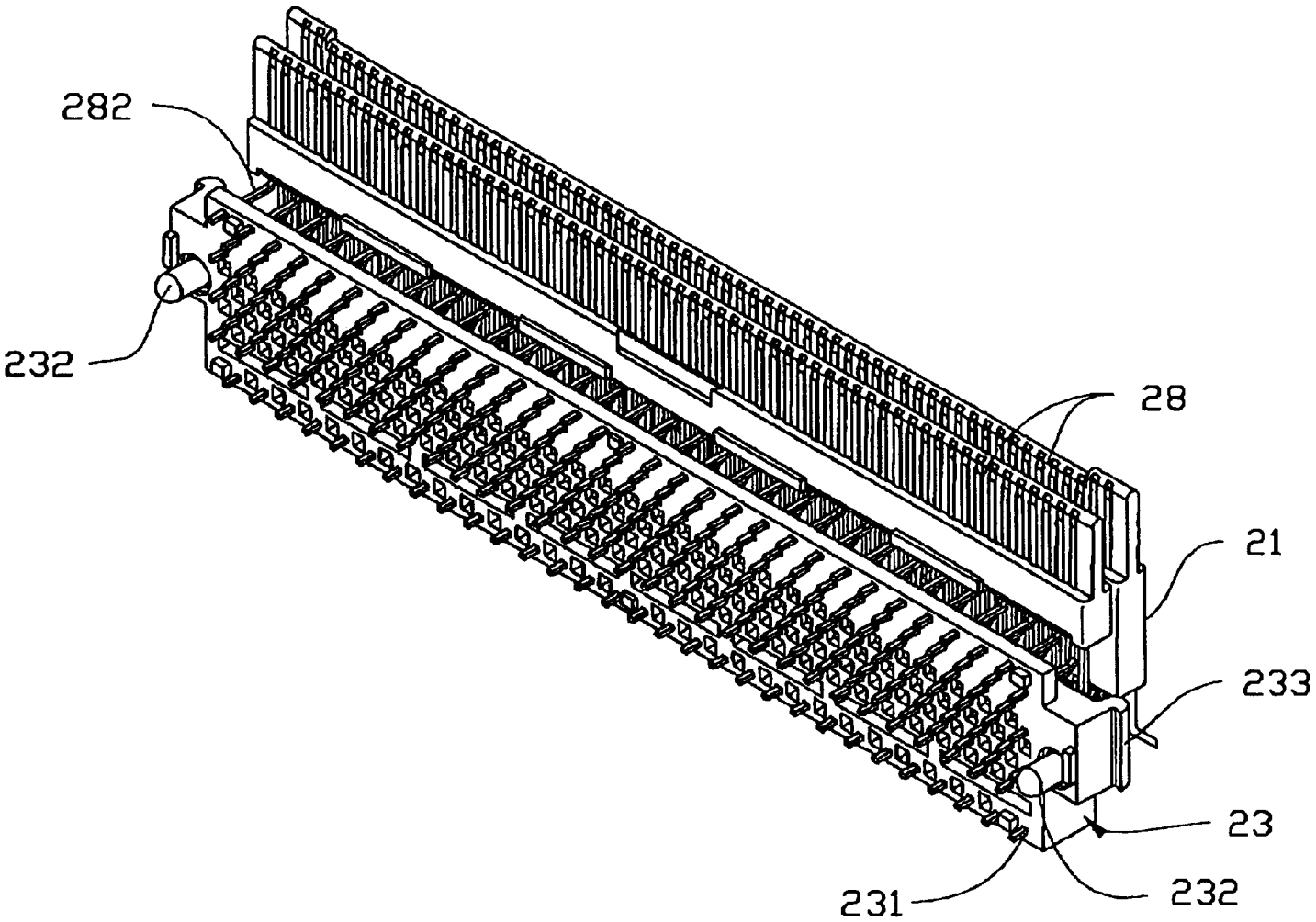
FIG. 8 is a perspective view of the first and second insert plates mounted to the spacer.

The second insert plate 22 is then mounted to the first insert plate 21 by inserting the bosses 222 of the second insert plate 22 into the positioning holes 212 of the first insert plate 21 whereby the grounding plate 26 is interposed therebetween and the mounting sections 282 of the pins 28 of the second insert plate 22 are received in the corresponding holes 231 on the spacer 23 (FIG. 8). Since the pins 28 are located on each of the insert plates 21, 22 and mounted within the holes 231 of the spacer 23 in two separate "batches", the spacing between the pins 28 can be readily maintained thereby facilitating alignment of the pins 28 with respect to the holes 231 of the spacer 23.

Figure 9:
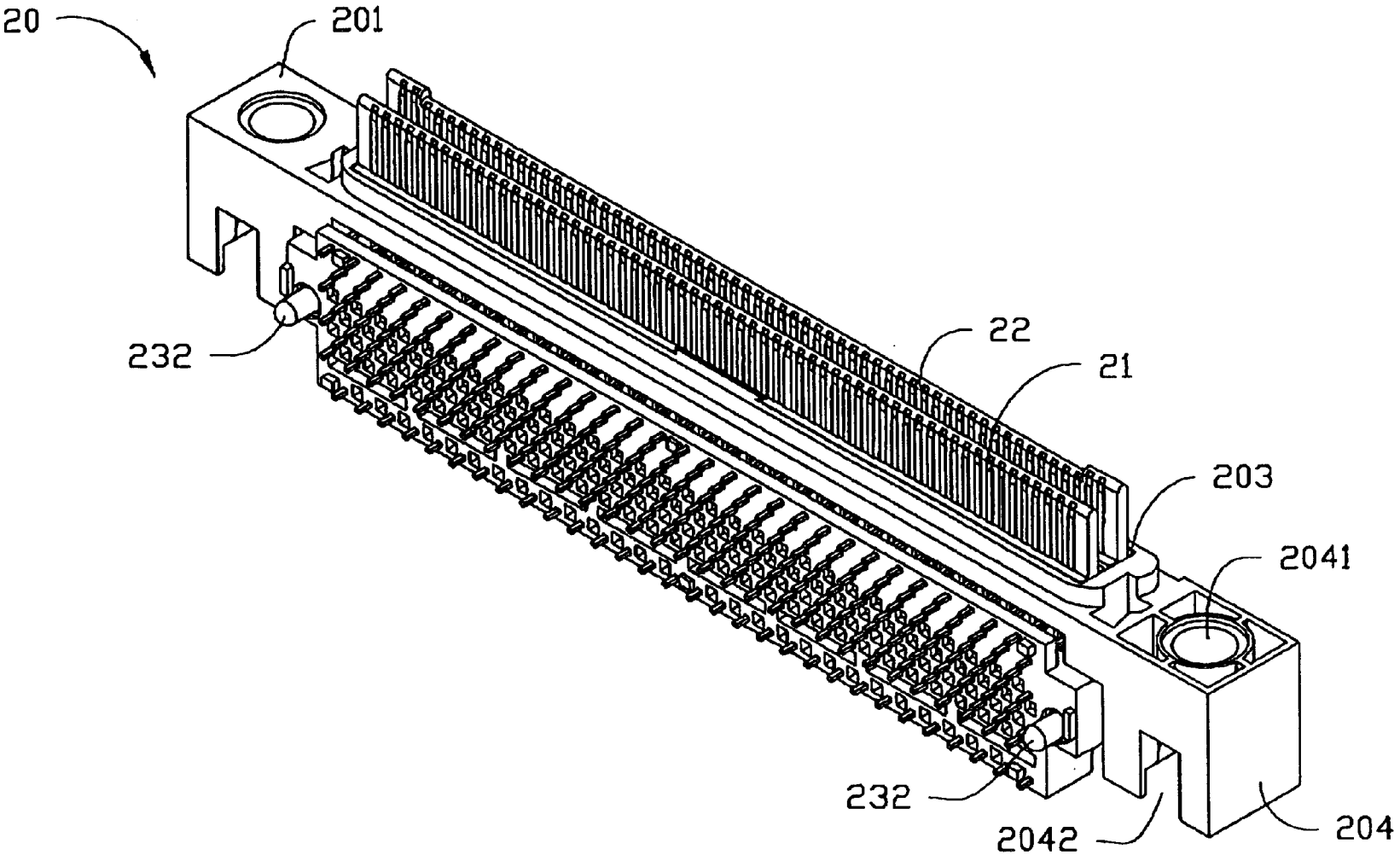
FIG. 9 is a perspective view of the sub-assembly of FIG. 8 mounted to the insulator.

The sub-assembly comprising the insert plates 21, 22 and the spacer 23 is then assembled to the insulator 20 by inserting the insert plates 21, 22 into the slot 203 of the insulator 20 whereby the notches 210, 220 and the positioning projections 211, 221 of the insert plates 21, 22 engage with the dovetailed projections 270 and positioning recesses 271, respectively. The barbs 233 of the spacer 23 then engage with the corresponding shoulders 2021 of the insulator 20 to securely fix the subassembly to the insulator 20 as shown in FIG. 9. The insert plates 21, 22 are sized to each have a portion thereof extending beyond the first side face 201 of the insulator 20.

Figure 10:
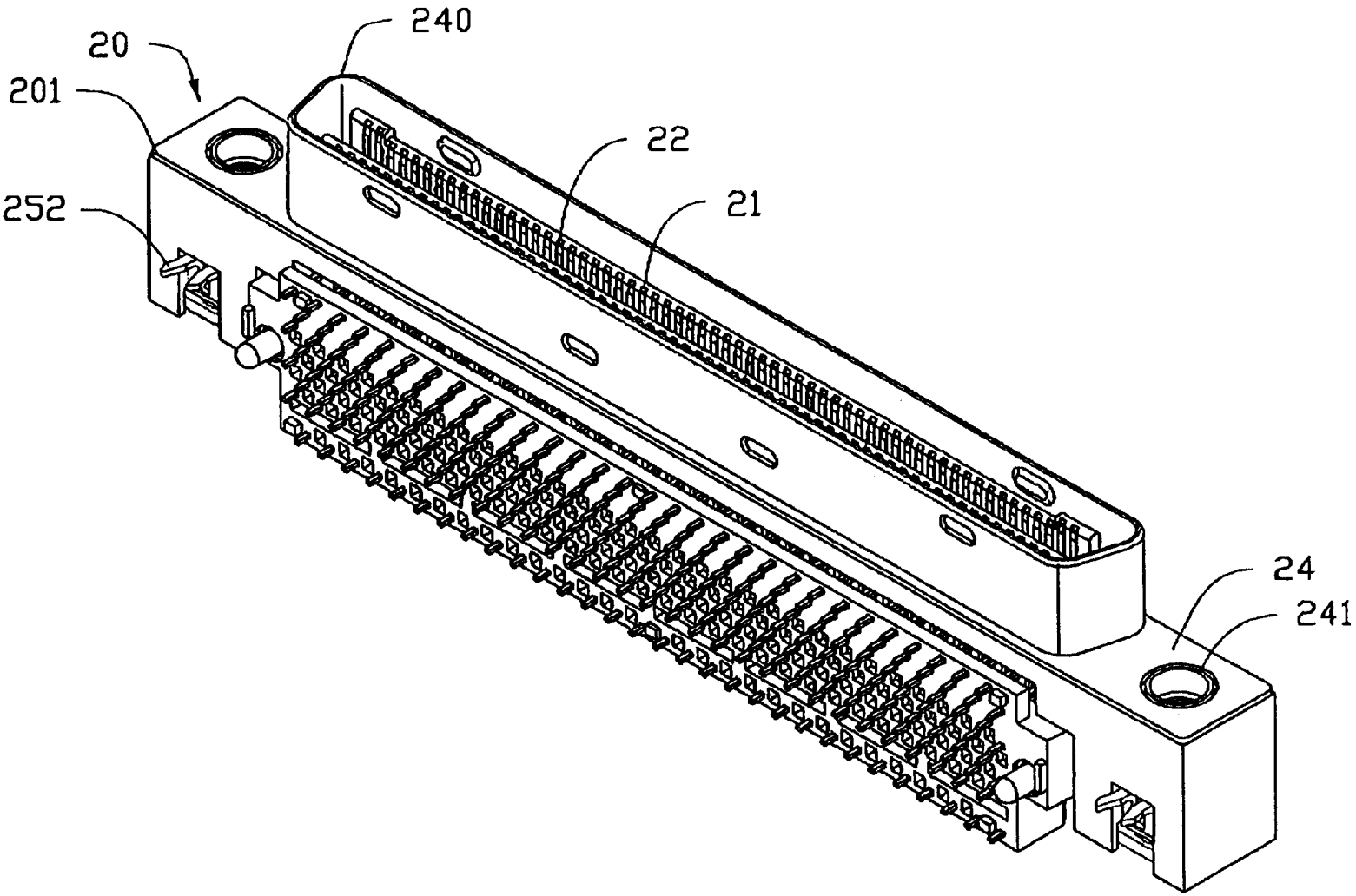
FIG. 10 is a perspective view of a shielding shell mounted to the sub-assembly of FIG. 9.

Thereafter, the shielding shell 24 is assembled to the raised section of the insulator 20 and thus mounted to the first side face 201 thereof to shield the portions of the insert plates 21, 22 extending beyond the insulator 20 (FIG. 10). The shell 24 is then secured to the insulator 20 by extending the fasteners 251 through the bores 241 of the shell 24 and the bores 2041 of the mounting blocks 204 of the insulator 20.

The above description reveals that the pins 28 are assembled to the insert plates 21, 22 thereby forming modularized components which are then received in and secured to the insulator 20 by the first retention means comprising the dovetailed projections 270 and the positioning recesses 271 formed on inner surfaces of the slot 203 of the insulator 20. The dovetailed projections 270 (cooperating with the notches 210, 220 of the insert plates 21, 22) and the positioning recesses 270 (cooperating with the positioning projections 210, 220 of the insert plates 21, 22) retain the insert plates 21, 22 and thus the pins 28 assembled thereto in position during the engaging/disengaging process between the plug-type connector 2 and the socket-type connector 3.

Figure 11:
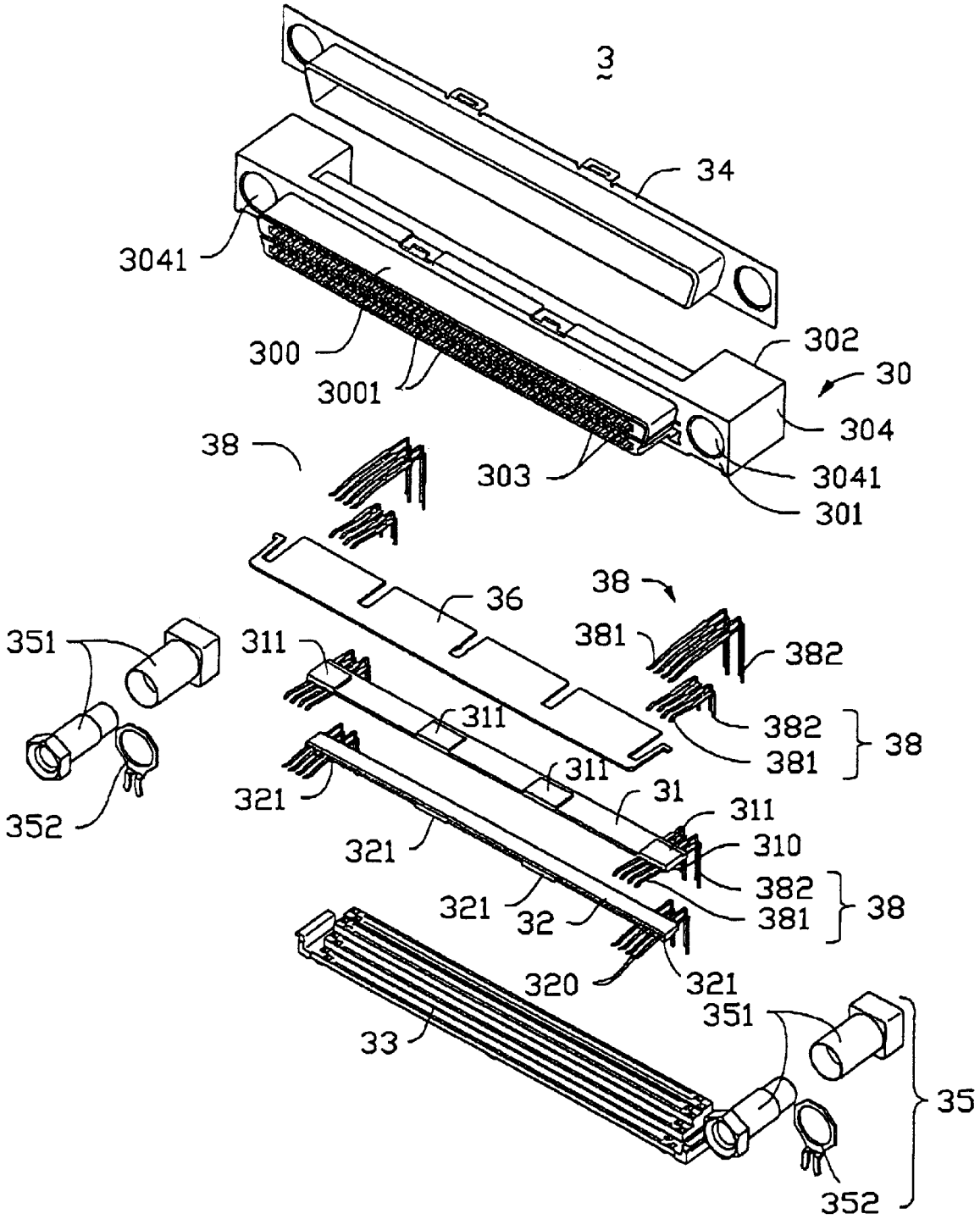
FIG. 11 is an exploded view of a socket-type connector constructed in accordance with the present invention.

Referring to FIG. 11, the socket-type connector 3 comprises an insulator 30 forming an elongate body (not labeled) made of dielectric material, having a first side face 301 forming a raised coupling section 300 for matingly engaging with the shielding shell 24 of the plug-type connector 2 and a second side face 302 opposite the first side face 301. Two slots 303, serving as "sockets" corresponding to and engageable with the "lugs" formed by the insert plates 21, 22 of the plug-type connector 2, are defined in the insulator 30 from the coupling section 300 on the first side face 301 to the second side face 302. Each of the slots 303 has two opposite inner surfaces defining a plurality of spaced pin receiving channels 3001 for receiving a corresponding conductive pin 38 therein whereby when the plug-type connector 2 and the socket-type connector 3 are mated with each other, the pins 28 of the plug-type connector 2 engage with the pins 38 of the socket-type connector 3 and an electrical connection is established therebetween. Thus, the pins 38 are arranged in four rows and each of the slots 303 has two rows of pins 38 disposed therein.

Figure 12:
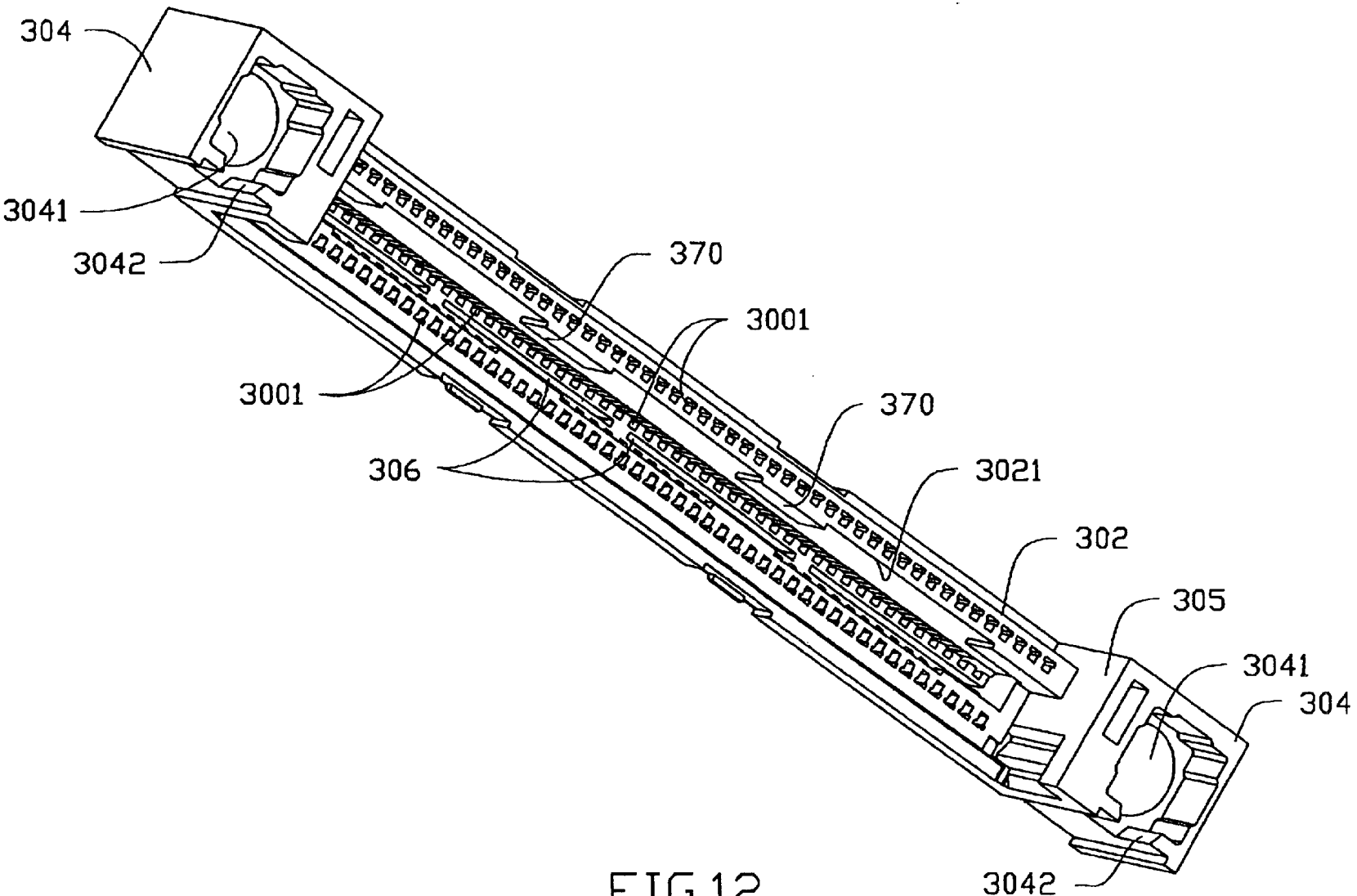
FIG. 12 is a perspective view of an insulator of the socket-type connector of FIG. 11.

Also referring to FIG. 12, the insulator 30 defines an elongate notch 3021 in the second side face 302 whereby one of the two rows of the pin receiving channels 3001 of each of the two slots 303 is received in the notch 3021. The remaining one of the two rows of pin receiving channels 3001 of each of the two slots 303 is received in the portion of the second side face 302 above or below the notch 3021. The notch 3021 forms a plurality of retaining members 370 on opposite inner surfaces thereof. Each retaining member 370 defines a step-like configuration.

The insulator 30 integrally forms a mounting block 304 at each distal end thereof. A space 305 is defined between the two mounting blocks 304 and the second side face 302 of the insulator 30 for accommodating a spacer 33 therein. Each of the mounting blocks 304 defines a bore 3041 between the first side face 301 and the second side face 302 and a notch 3042 in the second side face 302 for respectively receiving a fastener 351 comprising two separate but connectable members and an anchoring ring 352 having two elastically deformable legs. The fastener 351 and the anchoring ring 352 together constitute securing means 35 of the insulator 30.

A first insert plate 31 and a second insert plate 32 are respectively received in the two slots 303 of the insulator 30. Each insert plate 31, 32 defines a plurality of pin receiving channels 310, 320 therein for retaining the pins 38 received in the notch 3021 of the insulator 30.

Each of the pins 38 has an engaging section 381 and a mounting section 382. The engaging section 381 is arranged in the slots 303 while the mounting section 382 extends beyond the second side face 302 of the insulator 30 for surface mounting to a printed circuit board (not shown). The engaging sections 381 of the pins 38 are retained in the pin receiving channels 3001 defined in inner surfaces of the slots 303. A portion of the pins 38 that are received in the notch 3021 of the insulator 30 is received and fixed in the pin receiving channels 310, 320 of the insert plates 31,32.

The connector 3 comprises second retention means for retaining the insert plates 31, 32 in the slots 303 of the insulator 30. The second retention means comprises four projections 311, 321 formed on one surface of each of the insert plates 31, 32 facing away from each other. Each projection 311, 321 defines a step-like configuration. The projections 311, 321 engage the step-like retaining members 370 in the notch 3021, as shown in FIG. 16, thereby preventing the insert plates 31, 32 from moving out of the insulator 30 from the second side face 302.

Figure 13:
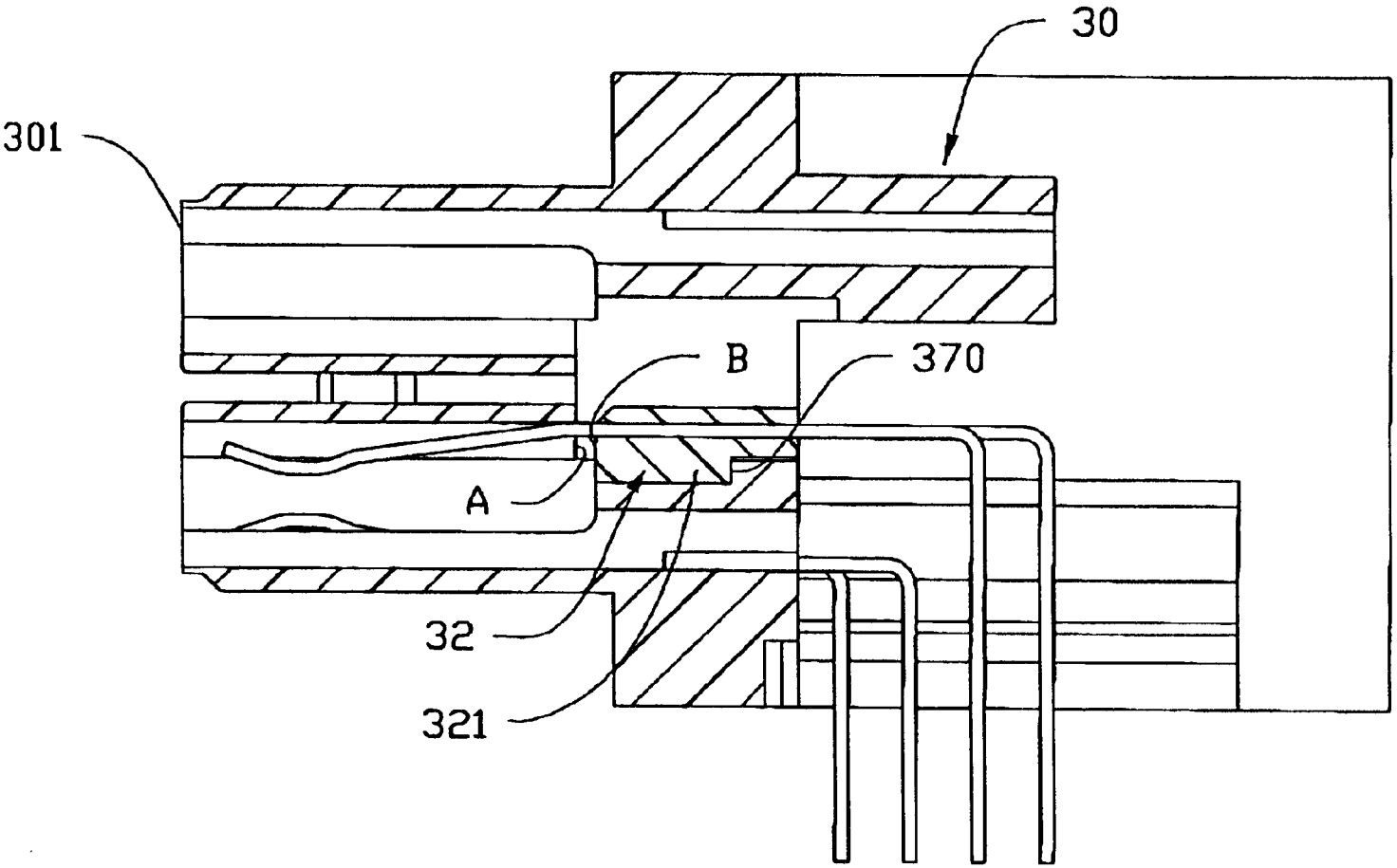
FIG. 13 is a cross-sectional view of a first insert plate mounted to the insulator of FIG. 12.

As shown in FIG. 13, the second insert plate 32 forms an inner edge B for engaging with an inner face A of the notch 3021 of the insulator 30 thereby preventing the second insert plate 32 from moving out of the insulator 30 from the first side face 301.

Figure 14:
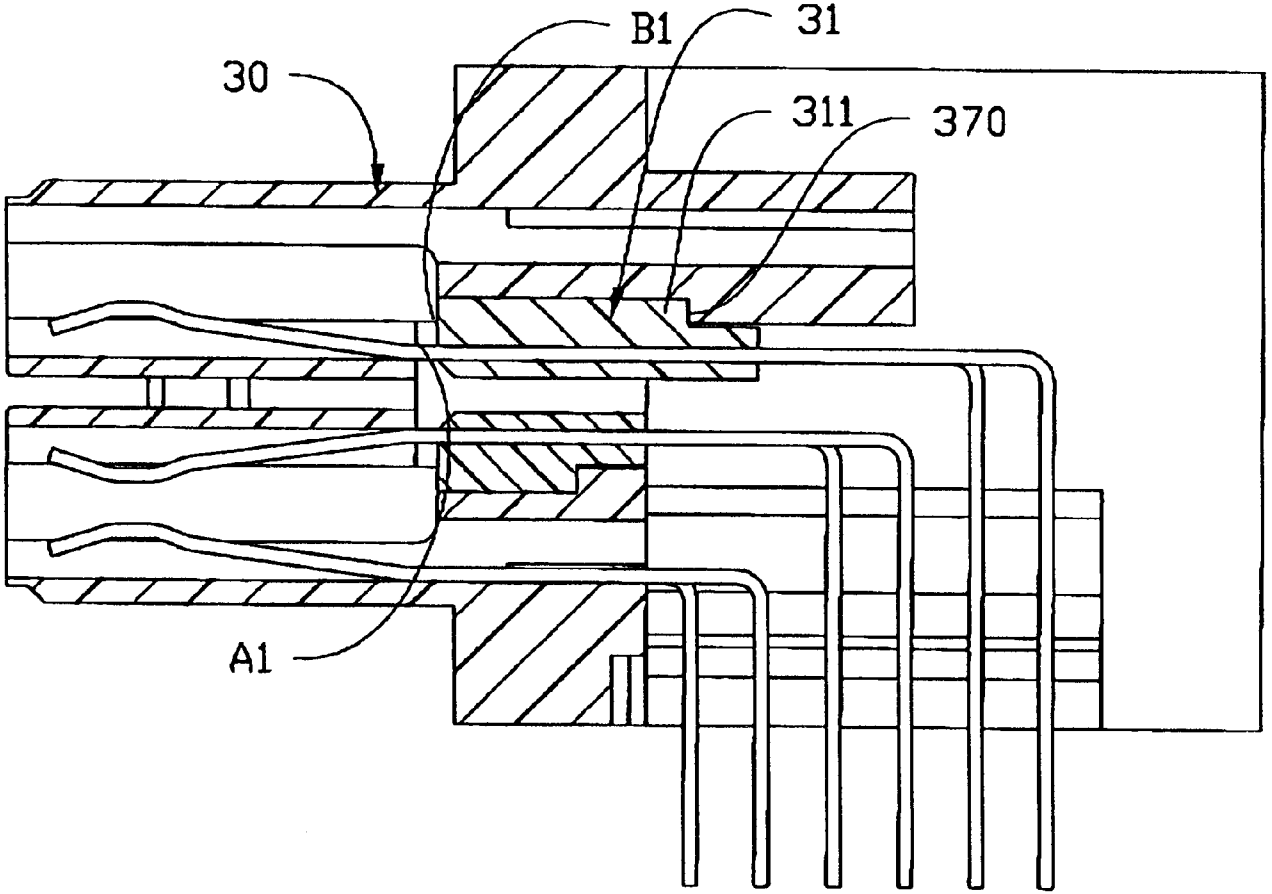
FIG. 14 is a cross-sectional view of a second insert plate mounted to the insulator.

Similarly, as shown in FIG. 14, the first insert plate 31 forms an inner edge B1 for engaging with an inner face Al of the notch 3021 thereby preventing the first insert plate 31 from moving out of the insulator 30 from the first side face 301.

Figure 15:
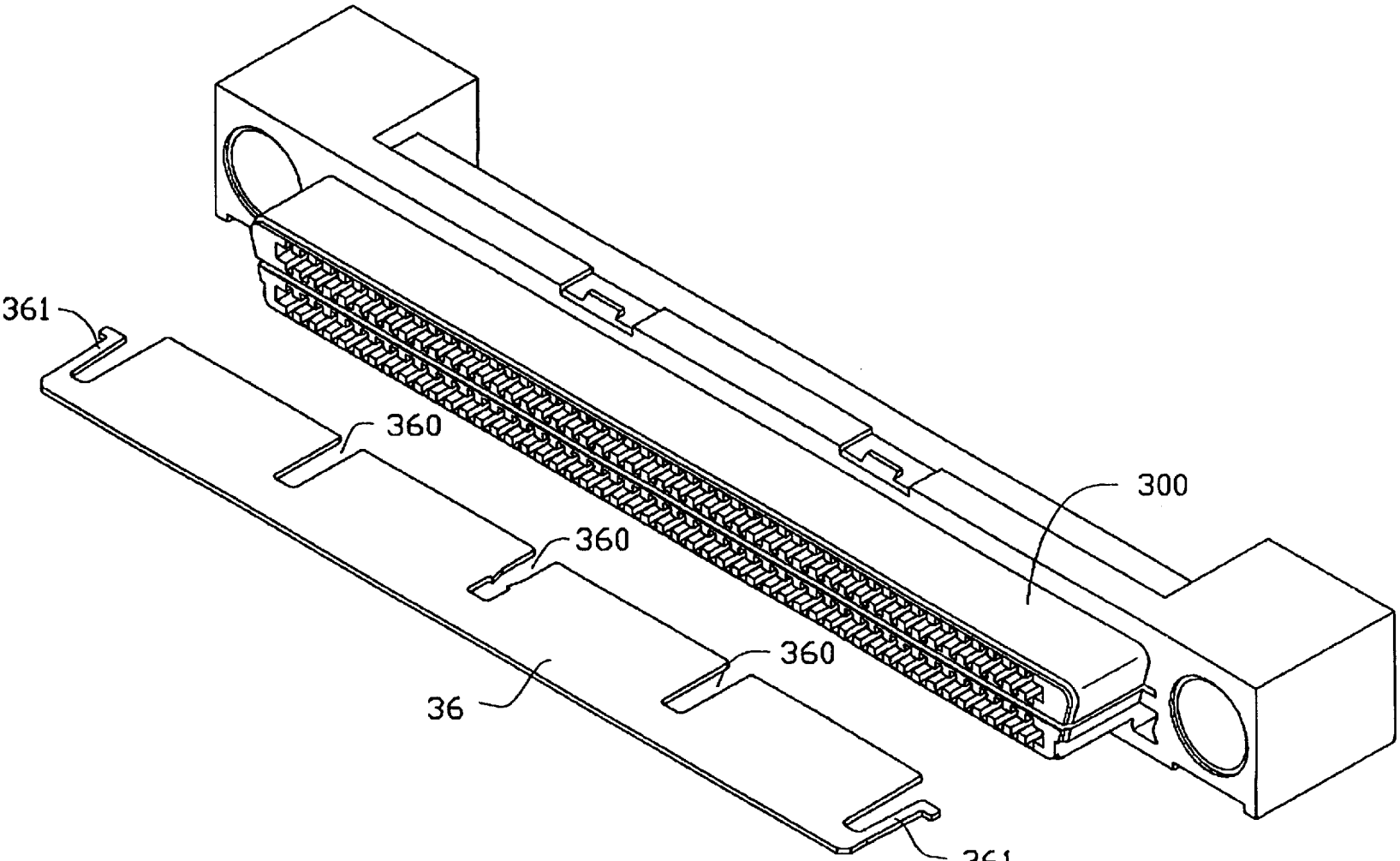
FIG. 15 is a perspective view of the insulator of the socket-type connector and a grounding plate to be mounted thereto.
Figure 16:
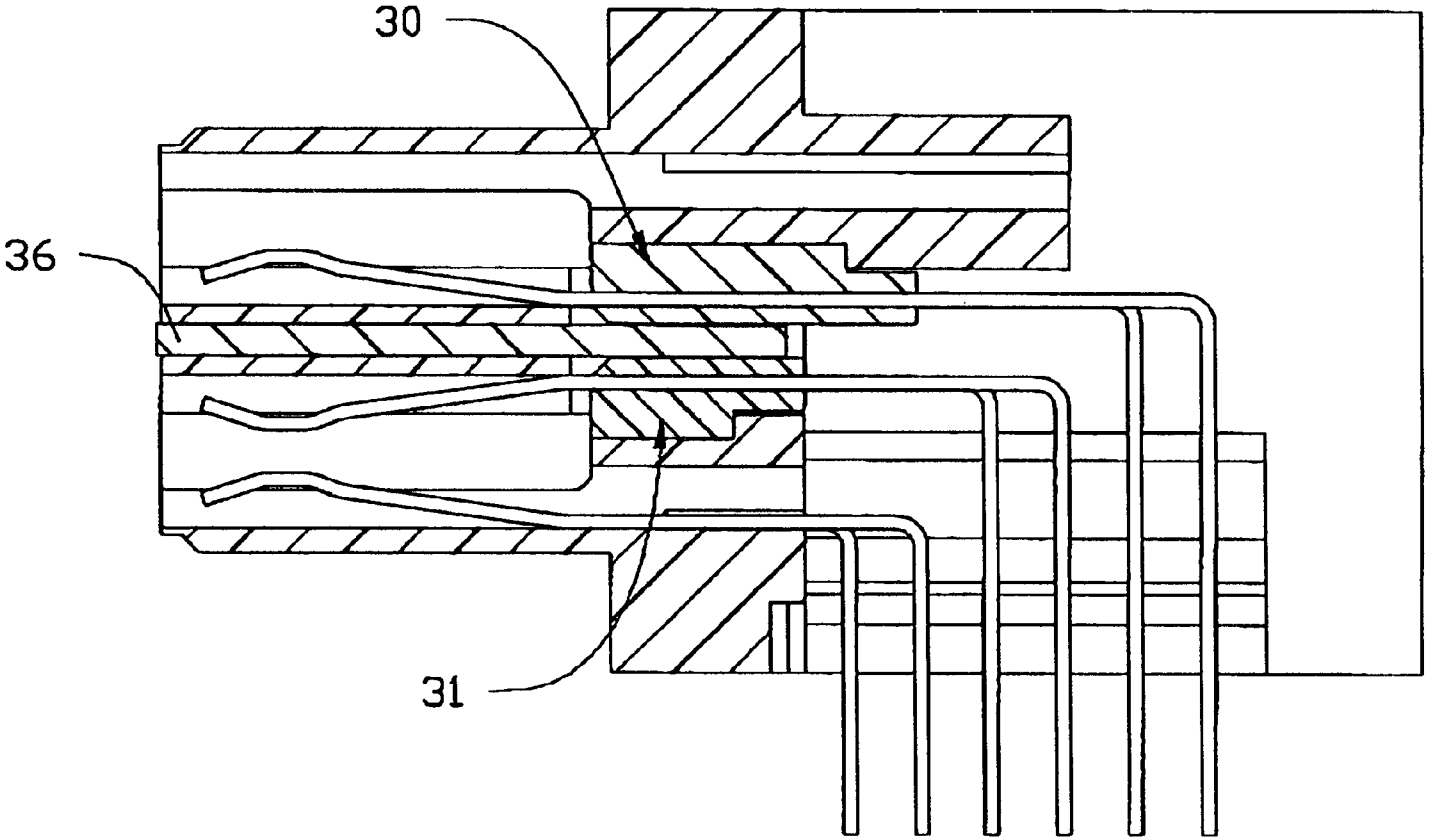
FIG. 16 is a cross sectional view of FIG. 15.
Figure 17:
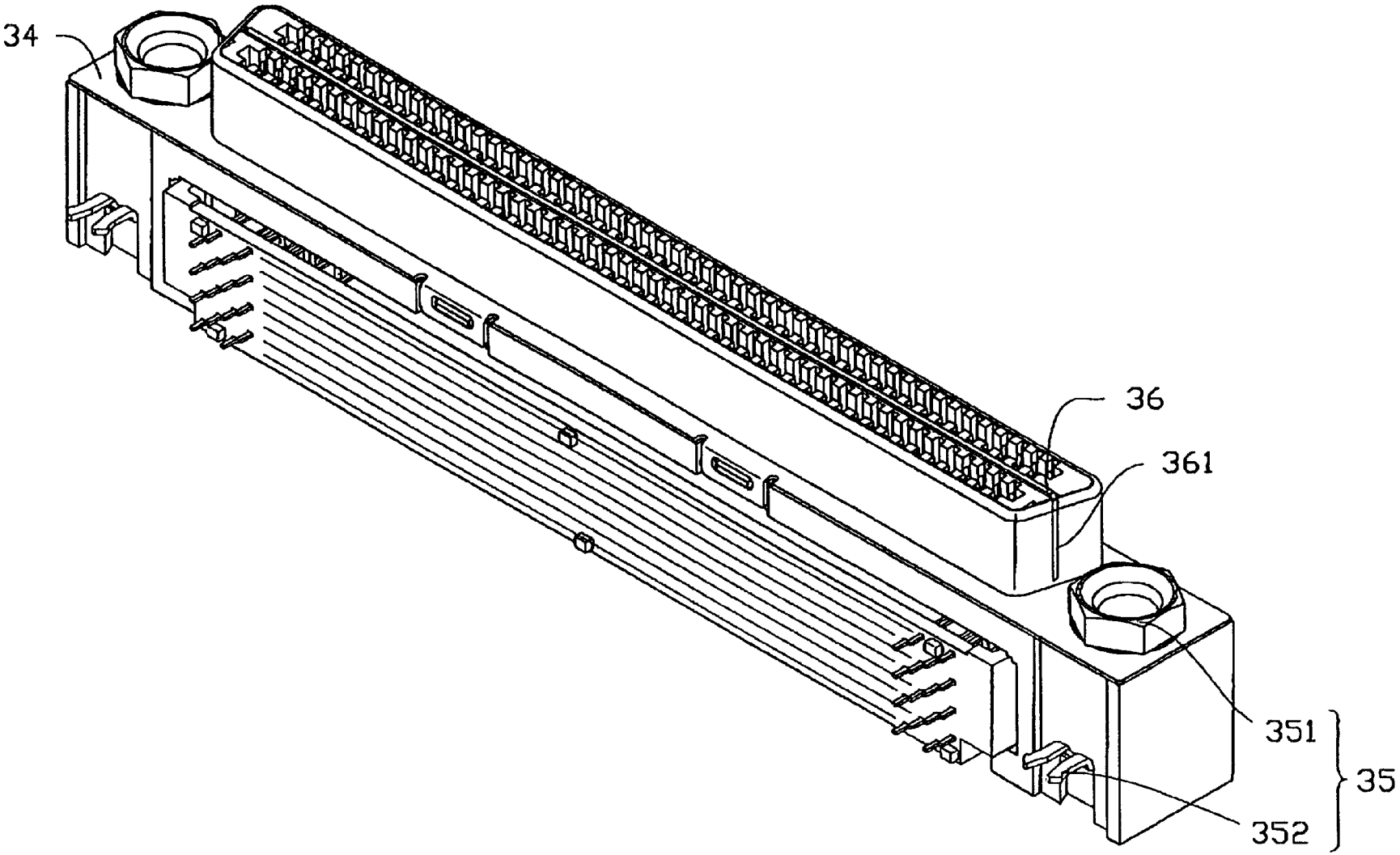
FIG. 17 is an assembled view of FIG. 11.

The coupling section 300 of the insulator 30 comprises a slit 306 (FIG. 12) defined between the two slots 303 for receiving a grounding plate 36 therein as shown in FIGS. 15 and 16. The grounding plate 36 defines a plurality of notches 360 for engaging with support connections formed in the slit 306 thereby retaining the grounding plate 36 in the slit 306. The grounding plate 36 forms two L-shaped resilient arms 361 extending from opposite distal ends thereof. Referring to FIG. 17, when the grounding plate 36 is received in the slit 306 the arms 361 extend slightly beyond the slit 306 thereby engaging with the shell 34 and establishing electrical connection therewith for providing a better shielding effect.

Similar to the plug-type connector 2, the spacer 33 of the socket-type connector 3 is accommodated in the space 305 defined between the two mounting blocks 304 of the insulator 30. The spacer 33 defines a plurality of holes for receiving and retaining the mounting sections 382 of the corresponding pins 38 therein. The spacer 23 forms barbs for engaging with corresponding shoulders provided on the mounting blocks 304 proximate the second side face 301 of the insulator 30 thereby fixing the spacer 33 thereto.

A shielding shell 34 is fixed to the first side face 301 of the insulator 30. The shell 34 interferentially engages with and encloses the coupling section 300 of the insulator 30. The shielding shell 34 forms two end extensions (not labeled) each defining a bore therethrough for receiving the fastener 351 received in the bore 3041 of each of the mounting blocks 304 of the insulator 30 thereby securing the shielding shell 34 thereto. The shell 34 forms a plurality of holed side lugs (not labeled) for engaging with projections (not labeled) formed on the insulator 30 for securing the shell 34 thereto.

The socket-type connector 3 is assembled by sequentially inserting the second and first insert plates 32, 31 into the notch 3021 of the insulator 30 whereby the engaging sections 381 of the pins 38 fixed to the insert plates 31, 32 are received in the corresponding pin receiving channels 3001 in the slots 303. The insert plates 31, 32 are retained in position by means of the engagement between the projections 311, 321 of the insert plates 31, 32 and the retaining members 370 formed in the notch 3021 of the insulator 30, and the engagement between the inner edges B1, B of the insert plates 31, 32 and the inner faces A1, A of the notch 3021 of the insulator 30, as seen in FIGS. 13 and 14.

The remaining pins 38 are then inserted into the respective pin receiving channels 3001 from the second side face 302 of the insulator 30 with the aid of additional jigs (not shown). The grounding plate 36 is then inserted into the slit 306 as shown in FIGS. 15 and 16. Thereafter, the shielding shell 34 is assembled around the coupling section 300 as shown in FIG. 17.

Although the present invention has been described with respect to a preferred embodiment, it is obvious that equivalent alterations and modifications will occur to those skilled in the art upon reading and understanding the above detailed description. The present invention includes all such equivalent alterations and modifications and is limited only by the scope of the appended claims.

What is claimed is:

1. A connection system comprising a plug-type connector and a socket-type connector matingly engaged together;

the plug-type connector comprising:

an insulator having a first side face and an opposite second side face and at least one slot defined between the first side face and the second side face, at least one insert plate received in the slot and defining a plurality of grooves therein, a plurality of conductive pins received and fixed in the grooves of the insert plate to form a unitary member, each of the pins having an engaging section arranged within the slot and a mounting section extending beyond the second side face of the insulator, and first retention means comprising mating projections and recesses respectively formed in the slot of the insulator and in the insert plate; and the socket-type connector comprising:

an insulator having a first side face and a second side face opposite the first side face, the first side face forming a raised coupling section thereon, at least one slot being defined through the coupling section to the second side face, at least one row of pin receiving channels being defined on an inner surface of the slot, at least one insert plate received in the slot and defining a plurality of grooves therein, a plurality of conductive pins received and fixed in the grooves of the insert plate to form a unitary member, each of the pins having an engaging section arranged within the slot and received in the respective pin receiving channel and a mounting section extending beyond the second side face of the insulator, and second retention means comprising abuttingly engageable portions respectively formed on the insulator and the insert plate for securely retaining the insert plate within the slot of the insulator.

2. The connection system as claimed in claim 1, wherein each of the plug-type and socket-type connectors comprises a spacer for retaining the mounting sections of the pins in position.

3. The connection system as claimed in claim 1, wherein the plug-type connector and the socket-type connector each comprise a first insert plate and a second insert plate received in the insulator and spaced from each other.

4. The connection system as claimed in claim 3, wherein a grounding plate is arranged between the insert plates.

5. The connection system as claimed in claim 1, wherein the first retention means of the plug-type connector defines at least one first recess in an inner surface of the slot proximate the second side face of the insulator for engaging with a first projection formed on the insert plate, both the first projection and the first recess having a rectangular configuration.

6. The connection system as claimed in claim 1, wherein the second retention means of the socket-type connector comprises at least one step-like member on the insert plate for engaging with at least one step-like member in the insulator.

7. An electrical connector comprising:

an insulator having a first side face, a second side face opposite the first side face, and at least one slot defined between the first side face and the second side face;

at least one insert plate received in the slot and defining a plurality of grooves therein;

a plurality of conductive pins received and fixed in the grooves of the insert plate to form a unitary member, each of the pins having an engaging section arranged within the slot and a mounting section extending beyond the second side face of the insulator; and retention means comprising mating projections and recesses formed in the slot of the insulator and defined in the insert plate, respectively.

8. The electrical connector as claimed in claim 7, wherein the connector further comprises a spacer for retaining the mounting sections of the pins in position.

9. The electrical connector as claimed in claim 7, wherein the connector comprises a first insert plate and a second insert plate received in the insulator and abutting against each other.

10. The electrical connection as claimed in claim 7, wherein a grounding plate is arranged between the insert plates.

11. The electrical connection as claimed in claim 7, wherein the retention means comprises at least one first recess defined in an inner surface of the slot proximate the second side face of the insulator, each first recess being engageable with a first projection formed on the insert plate, both the first projection and the first recess having a rectangular configuration.

12. The electrical connector as claimed in claim 11, wherein the retention means further comprises at least a dovetail-shaped second projection formed on the inner surface of the slot proximate the first side face of the insulator, each second projection being engageable with a second notch defined in the insert plate.

13. An electrical connector, comprising:

an insulator having a first side face and a second side face opposite the first side face, the first side face forming a raised coupling section thereon, at least one slot defined through the coupling section to the second side face, at least one row of pin receiving channels defined in an inner surface of the slot;

at least one insert plate received in the slot and defining a plurality of grooves therein;

a plurality of conductive pins retained in the grooves on the insert plate to form a unitary member, each of the pins having an engaging section arranged within the slot and received in the corresponding pin receiving channel and a mounting section received in the corresponding groove of the insert plate and extending beyond the second side face of the insulator; and retention means comprising abuttingly engageable portions respectively formed on the insulator and the insert plate for securely retaining the insert plate within the slot of the insulator.

14. The electrical connector as claimed in claim 13, wherein the connector comprises a first insert plate and a second insert plate received in the insulator and spaced from each other.

15. The electrical connection as claimed in claim 14, wherein a grounding plate is arranged between the two insert plates.

16. The electrical connector as claimed in claim 13, wherein the retention means comprises at least one step-like member on the insert plate and at least one step-like member in the insulator for engaging with each other.

17. The electrical connector as claimed in claim 16, wherein the retention means further comprises an inner edge formed on the insert plate for being abuttingly engageable with an inner face of the insulator.

18. An electrical connector, comprising:

an insulator having a first side face and a second side face opposite the first side face, the first side face forming a raised coupling section thereon, a first slot and a second slot defined through the coupling section to the second side face, each of the first and second slots having two inner surfaces each having one row of pin receiving. channels defined therein, a first row of the first slot being adjacent to but spaced from a second row of the second slot, a notch being defined in the second side face to accommodate the first row of the first slot and the second row of the second slot therein;

a first insert plate and a second insert plate respectively received in the first slot and the second slot, each defining a plurality of grooves therein;

a plurality of conductive pins, each comprising an engaging section received in the corresponding pin receiving channel and a mounting section, the mounting section of each of the pins associated with the first row of the first slot and the second row of the second slot being received and fixed in the corresponding groove of the insert plates, the pins being arranged in such a way that the engaging sections are located in the slots and the mounting sections extend beyond the second side face of the insulator; and retention means comprising abuttingly engageable portions formed on the insulator and the insert plates for securely retaining the insert plates within the corresponding slots of the insulator.

19. The electrical connection as claimed in claim 18, wherein a grounding plate is arranged between the two insert plates.

20. An electrical connector comprising:

an insulator defining at least one slot, said slot defining two opposite inner surfaces defining a plurality of spaced pin receiving channels;

a first set of pins being directly installed into and received within the corresponding pin receiving channels on one of said two opposite inner surfaces; and a second set of pins being first assembled to an insert plate, and successively said insert plate with the associated second set of pins installed into the slot wherein said second set of pins are positioned on the other of said two opposite inner surface.

21. A method for assembling a connector comprising steps of:

providing the connector with an insulator defining at least one slot and at least two rows of pin receiving channels;

providing an insert plate and installing a first set of pins thereon;

inserting said insert plate with the associated first set of pins into the slot wherein said first set of pins are substantially received within one row of the pin receiving channels; and inserting a second set of pins into the other row of pin receiving channels.

* * * * *